US005111890A

United States Patent [19]

Ranger et al.

[11] Patent Number: 5,111,890

[45] Date of Patent: May 12, 1992

[54] HAMMER DRILL

[75] Inventors: Ulrich Ranger; Karl Wanner; Johann Kaltenecker, all of Leinfelden-Echterdingen; Manfred Hellbach, Ostfildern; Gerhard Meixner, Filderstadt, all of Fed. Rep. of Germany

[73] Assignee: Robert Bosch GmbH, Stuttgart, Fed. Rep. of Germany

[21] Appl. No.: 646,606

[22] PCT Filed: Jul. 19, 1989

[86] PCT No.: PCT/DE89/00478

§ 371 Date: Jan. 29, 1991

§ 102(e) Date: Jan. 29, 1991

[87] PCT Pub. No.: WO90/01400

PCT Pub. Date: Feb. 22, 1990

[30] Foreign Application Priority Data

Aug. 2, 1988 [DE] Fed. Rep. of Germany ..... 3826213

[51] Int. Cl.[5] ..... B25D 9/04

[52] U.S. Cl. ..... 173/104; 173/14; 173/201

[58] Field of Search ..... 173/104, 109, 116, 117, 173/118, 134, 139, 14

[56] References Cited

U.S. PATENT DOCUMENTS

| | | | |
|---|---|---|---|
| 3,774,699 | 11/1973 | Schmuck | 173/109 |
| 3,921,729 | 11/1975 | Schmuck | 173/116 |
| 4,582,144 | 4/1986 | Mizutani | 173/116 |
| 4,823,886 | 4/1989 | Dyatov | 173/116 |
| 4,825,961 | 5/1989 | Neumaier et al. | 173/109 |

*Primary Examiner*—Frank T. Yost
*Assistant Examiner*—Scott A. Smith
*Attorney, Agent, or Firm*—Michael J. Striker

[57] ABSTRACT

A power hammer drill includes a tool holder and an air cushion striking mechanism for driving a tool and including a striker, a reciprocating piston for displacing the striker, and an axially displaceable guide tube for guiding the piston. A device for holding the striker in a forward position thereof adjacent to the tool holder in an idling condition of the hammer drill is provided in the hammer drill. The device has a guide element fixed in the drill housing for guiding the guide tube. The guide tube has a control opening for venting the air cushion and which remains in open or closed condition dependent on axial position of the guide tube.

13 Claims, 4 Drawing Sheets

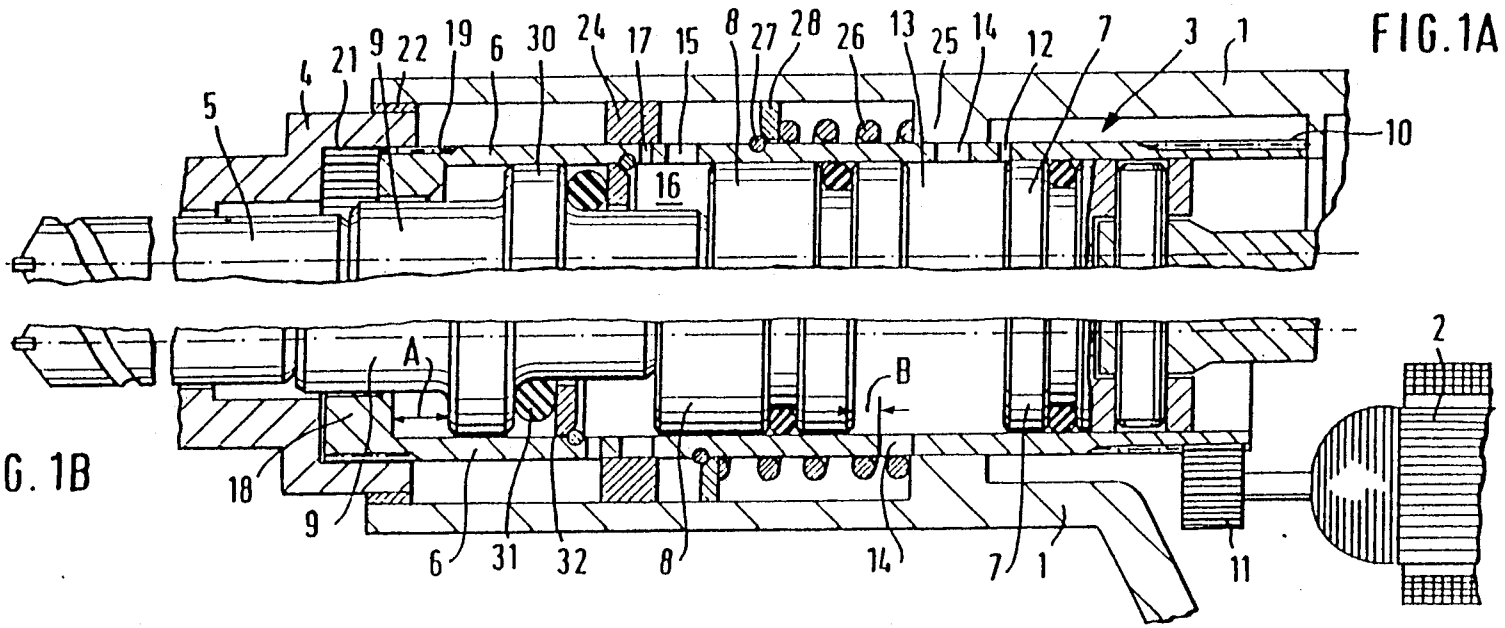
FIG. 1A
FIG. 1B
1
2
3
4
5
6
7
8
9
10
11
12
13
14
15
16
17
18
19
21
22
24
25
26
27
28
30
31
32
A
B
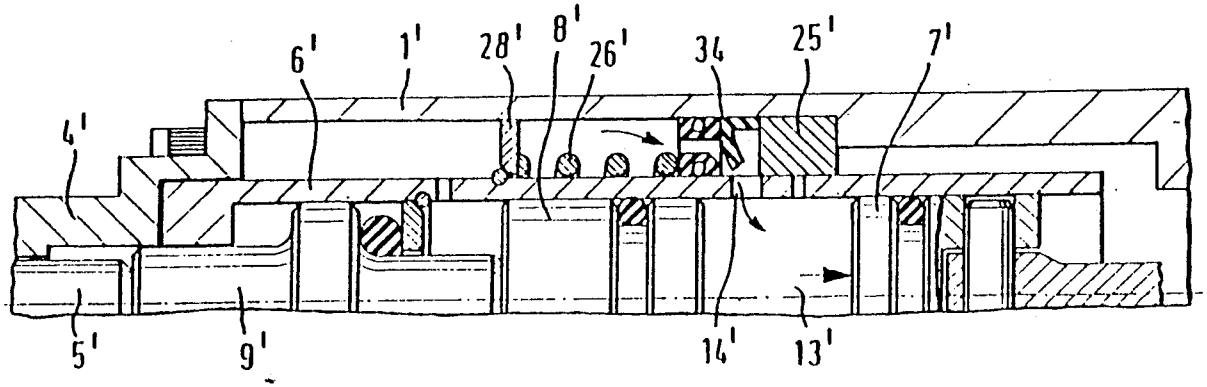
FIG. 2
1'
4'
5'
6'
7'
8'
9'
13'
14'
25'
26'
28'
34

HAMMER DRILL

BACKGROUND OF THE INVENTION

The invention relates to a hammer drill, in particular a percussion hammer comprising a tool holder, an air cushion striking mechanism including a piston displaceable in a guide tube and a striker, and a device which holds the striker in its front position facing the tool holder by venting the air cushion, when the hammer is idle. In a hammer known from DE-PS 26 41 070, a fixed guide tube in which the piston and striker are guided so as to be tight and sliding, is enclosed by a control body which is axially displaceable for idling control. The control body embraces the guide tube at the front in such a way that a collar of the intermediate anvil contacts the base of the control body and the latter can accordingly be pushed axially inward during hammer operation. Such a construction has the disadvantage that it is only suitable for pure chisel hammers, but not for drill hammers with rotary drive. A rotary drive of the guide tube is not possible, and the rotating movement can also not be transmitted to the tool holder, since the control body prevents the connection of the guide tube with the tool holder. Moreover, the additional control body brings about an increased cost in manufacturing and is a hindrance when the hammer is to be supplemented with further functions.

SUMMARY OF THE INVENTION

The object of the invention is a percussion hammer in which an additional control sleeve can be entirely dispensed with. The object of the invention is achieved by providing a displaceable guide tube having a plurality of guide elements and a control opening in an area of one of the guide elements, which opening can be closed or opened by tube displacement. The invention makes possible a rotary drive of the hammer and guide tube which can be displaceable to the tool holder, and a striking mechanism which is simple and has fewer parts. In addition, the idling behavior is improved by a greater distance between the striker and idling bore hole. In the arrangement of the idle control openings outside the travel path of the piston and accordingly outside of the compression area of the air cushion, the guide element need not be sealed particularly relative to the guide tube. The gap seal between the two structural component parts is sufficient.

The striker is constantly forced against the anvil during idling by providing the idle control opening with a valve. Idling is accordingly ensured in a substantially more reliable manner—even when the machine is held vertically facing upward.

The advantageous inventive idea may be applied to a hammer with the proven L-shaped arrangement of the striking mechanism and motor. Because of the gear ratio, the bevel gear for the rotary drive is still located at the place, as shown in FIGS. 4 and 5, relative to the striking mechanism.

The hammer shown in FIG. 4 has the advantage that the switching mechanism for switching on and off or blocking the rotational movement is constructed in a very simple manner and is very economical and simple to manufacture. The switching ring shown in FIG. 4 and comprising only one toothing can also be used for switching a hammer striking mechanism on and off.

The present invention both as to its construction so to its mode of operation, together with additional objects and advantages thereof, will be best understood from the following detailed description of the preferred embodiments when read with reference to the accompanying drawings.

BRIEF DESCRIPTION OF THE DRAWINGS

FIGS. 1A to 1B show cross-sectional views of longitudinal hammer drill, according to a first embodiment of the invention in two different positions of the guide tube;

FIG. 2 shows a longitudinal cross-sectional view of a second embodiment of a hammer drill according to the invention;

DESCRIPTION OF THE PREFERRED EMBODIMENTS

Figure 3A:
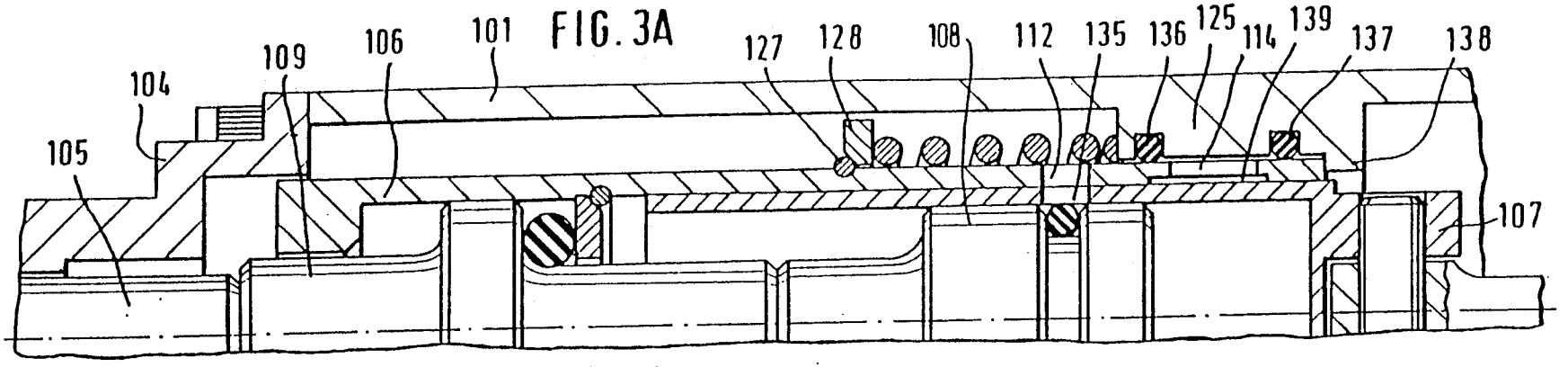
FIGS. 3A and 3B show cross-sectional views of a third embodiment of a hammer drill according to the invention in the hammering position and in the idling position of the striking mechanism.

A percussion hammer 2, shown in FIG. 1 comprises a motor 2, and a striking mechanism 3 arranged in a housing 1 of the percussion hammer. A tool holder 4 with inserted tool 5 is arranged in front of the striking mechanism 3.

A piston 7 driven by the motor 2, a striker 8 and anvil 9 are guided in a guide tube 6 of the striking mechanism 3. The guide tube 6 comprises longitudinal teeth 10 on the tube rear end circumference which teeth mesh with a toothed wheel 11. An intermediate shaft can also be connected between the guide tube 6 and the toothed wheel 11.

A refilling hole 12 for compensating for the air loss in the air cushion space 13, as well as one or more idle control openings 14, are provided in the wall of the guide tube 6. The two openings 12, 14 lie outside the piston path in which the air cushion is compressed, i.e. outside the compression area. Further toward the front in the direction of the tool holder 4, the guide tube 6 has a venting port 15 for the space 16 in front of the striker, as well as a throttle bore 17 for damping the idle stroke. At the front end, the guide pipe comprises an inwardly extending collar 18, which guides the anvil 9, and a longitudinal toothing 19 which engages in a toothing 21 of the tool holder 4.

The tool holder 4 is rotatably supported relative to the housing 1 by a bearing 22. The rotational movement of the tool holder 4 is transmitted to the tool 5 in a known manner, e.g. via projections, not shown, which engage grooves in the shaft of the tool 5. A first guide piece 25, which is formed as one piece with the housing 1 and is constructed as a collar, and a second guide piece 24, which is pressed into the housing, serve to guide the guide tube 6 in the housing 1. The first guide piece 25 can also be constructed as a guide ring to be inserted into the housing. A pressure spring 26 is supported against the guide piece 25 and, on the other side, contacts a retaining ring 28 which is fixed in the guide tube 6 with a securing ring 27. The axial displacement path of the guide tube 6 is defined at the front by the tool holder 4 and at the rear by a stop in the housing 1.

The anvil 9 comprises, in the center, a collar 30 and an O-ring 31 which contacts a retaining ring 21 secured in the guide tube 6.

The striking mechanism 3 is shown in the hammering position in FIG. 1A and in the idling position in FIG. 1B. The piston 7 is located on the left or at front dead center. During percussion operation, the control opening 14 is closed by the guide piece 25. During the compression of the air cushion 13, which occurs in the area in which the piston 7 is located in FIG. 1, the idle control opening 14 and also the refilling bore hole 12 are additionally closed by the striker 8.

When the tool 5 is removed from the working location, the spring 26 presses the guide tube 6 forward in the direction of the tool holder 4 (FIG. 1B). The control opening 14 is accordingly displaced out of the area of the guide piece 25 and is open. Vacuum pressure can no longer be built up in the air cushion 13, which the striker 8 reduces. The idle stroke of the striker 8 is dampened by the narrow throttle hole 17 which is now likewise open. At the same time, the venting port 15 is covered by the guide piece 24.

The striker can move forward at the last stroke farther than shown in FIG. 1B as it pushes the anvil 9 forward by the distance A between the collar 30 of the anvil and the collar 18 of the guide tube 6. The distance B between the rear edge of the striker 8 and the idle hole 14 is accordingly increased. This reduces the danger that the striker may possibly move back into the area of the idle control opening 14 when idling and close the hole 14 when it is undesirable.

The rotary drive of the hammer is ensured in every axial position of the guide tube by the longitudinal teeth 10; this is also true for the transmission of the rotational movement to the tool holder 4. However, the hammer can also be constructed as a pure percussion hammer without rotary drive in the same economical manner with displaceable guide tube, as shown in FIG. 2.

The embodiment according to FIG. 2 is similar to a great extent to the first embodiment. The same reference numbers are used, but with a prime. The tool holder 4' is rigidly connected with the housing 1'. The guide tube 6' is not driven during rotation. A valve 34, which is designed e.g. as a rubber diaphragm, is inserted in addition between the guide piece 25', which is constructed as a separate ring, and the pressure spring 26'. It lies in the path of flow of the air from the control opening 14' to the large-volume interior of the hammer. When the piston 7' returns to the right during idling, the valve 34 opens so as to prevent vacuum pressure from building up in the air cushion space 13'. During the forward stroke of the piston 7', the valve 34 closes so that the striker is forced forward against the anvil 9' by the developing air cushion.

FIG. 3 shows an embodiment with a type piston 107. The parts corresponding to those in the embodiment of FIGS. 1 and 2 are provided with reference numerals increased by 100. The type piston 107 has one or more holes 135 in its side wall, one of which holes coincides with the refilling hole 112 during hammer operation. This happens whenever the piston 107 is located in the front dead center position, as shown in FIG. 3.

The guide piece 125 at the housing 101 comprises two O-rings 136, 137 for additional sealing relative to the control opening 114. It carries a collar 138 as axial stop for the guide tube 106. In the hammering position shown in FIG. 3A, the idle control opening 114 is sealed by the guide piece 125.

Figure 3B:
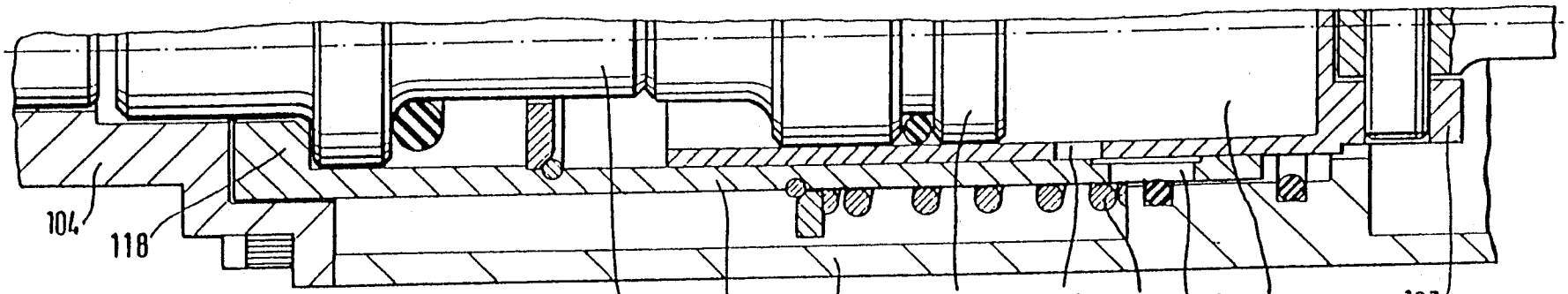

The guide piece 106 has a flat annular groove 139 on its inside in the area of the idle control opening 114. The air cushion space 113 is ventilated during idling via this annular groove, the control opening 114, and the hole 135, as can be seen in FIG. 3B. The annular groove is dimensioned in such a way that it communicates with the bore hole 135 in every position of the piston 107. The function of the striking mechanism corresponds in other respects to that of the first embodiment.

Figure 4:
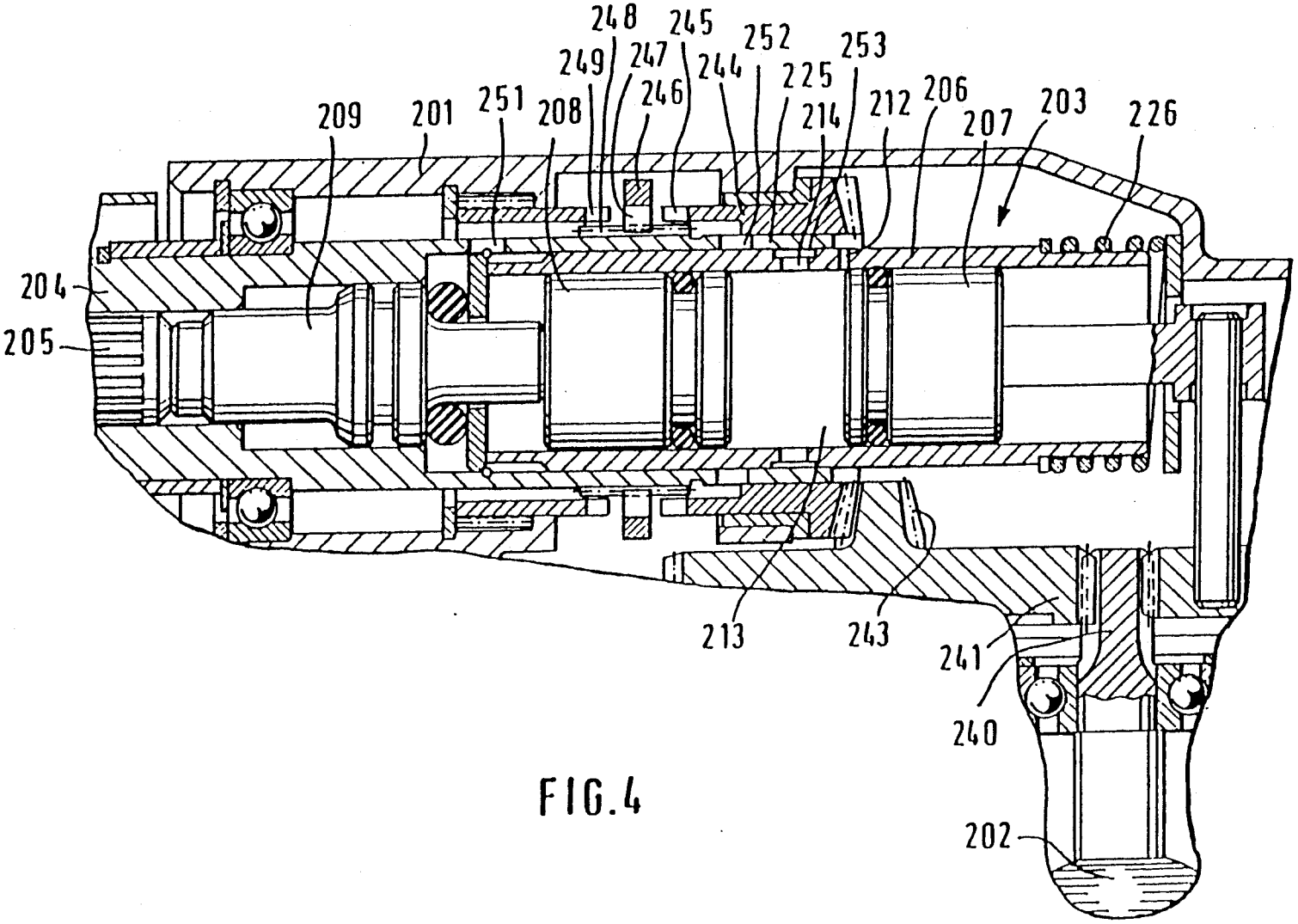
FIGS. 4 and 5 show cross-sectional views of fourth and fifth embodiments, respectively, of hammers according to the invention with an L-shaped arrangement of the striking mechanism and motor.

In the hammer according to FIG. 4, the parts corresponding to those in FIG. 1 are provided with reference numerals increased by 200. The motor 202 and striking mechanism 203 are arranged perpendicular to one another in an L-shaped construction.

A toothed wheel for the striker drive and a toothed spur gear 241 are driven by the motor pinion 240. The spur gear 241 carries a bevel gear toothing 243 as second toothing. This bevel gear toothing 243 meshes with a bevel gear 244 which is supported in the housing 201 and comprises a sleeve-shaped base body and coupling claws 245 located opposite the bevel gear toothing 243. An axially displaceable switching ring 246, which comprises teeth 247 and an be operated from the outside, can engage with the claws 245. These teeth 247 engage with longitudinal teeth 248 at the circumference of the guide piece 225 which is constructed as a sleeve. The switching ring 246 can also engage, as desired, in claws 249 which are securely connected with the housing 201. The longitudinal teeth 248 and the claws 245 and 249 have the same pitch, and the teeth 247 are constructed in such a way that they can engage the longitudinal teeth 248 and the claws 245 and 249 simultaneously. This enables the use of a simple stamped part as switching ring 246.

The guide piece 225 is securely connected in its front area with the tool holder 204; but the elements can also consist of two parts. The guide pipe 206 has a venting port 251 for the space in front of the striker 208 and openings 252 in the area of the bevel gear 244 for venting during idling. During idling, the openings 252 communicate with a recess 253 which connects the idling holes 214 with one another.

During the hammer operation shown in FIG. 4, the idle control openings 214 are sealed by the guide piece 225. The switching ring 246 is in the neutral position, so that the guide piece 225 can neither rotated nor blocked so as to be fixed with respect to rotation. The tool holder is accordingly freely rotatable. When the switching ring engages in the claws 249, the tool holder 304 is blocked so it does not rotate; when the switching ring engages in the claws 245, the tool holder is driven in rotation. A lever (e.g. eccentric lever), not shown, which extends through the housing 201 acts in a known manner at the toothless part of the switching ring 246 for shifting the same. When the tool 205 is lifted from the working location, the spring 226 presses the guide tube 206 to the left and forward, so that the recess 253 produces a connection between the control openings 214 and the openings 252. The air cushion space 213 is accordingly ventilated during idling as in the preceding embodiments.

Figure 5:
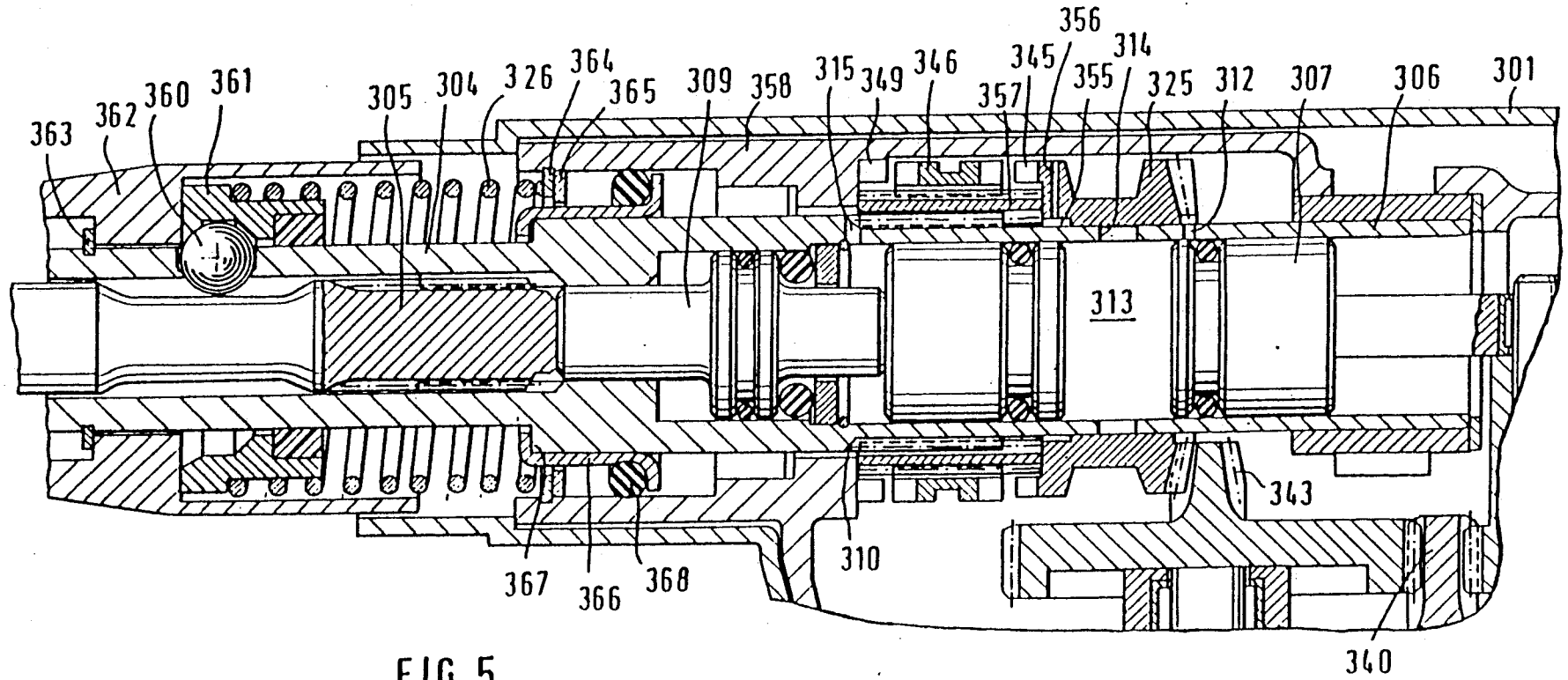

The embodiment according to FIG. 5 resembles that according to FIG. 4 with the exception that the guide tube 306 is formed in one piece with the tool holder 304. The parts corresponding to those in FIGS. 1 and 4 are designated by reference numbers increased by 300 or 100, respectively.

The rotary drive is transmitted via the bevel gear toothing 343 to the guide piece 325 having bevel gear teeth. As in the preceding embodiments, the guide piece 325 covers the idle control opening 314 during the hammer operation as shown in FIG. 4. A venting duct 356 extends from a recess 355 on the inside of the guide piece 325 into the interior of the housing. The guide piece 325 is supported against a sleeve 357 which contacts a housing part 358. The sleeve 357 comprises teeth on the outside and inside and engages longitudinal teeth 310 at the guide pipe 306 on one side and in internal teeth of the switching ring 346 on the other side.

The guide tube 306 is formed as one piece with the tool holder 304 having a locking element 360 for the tool 305. The locking element 360 is locked by an axially displaceable retaining ring 361. The latter is supported at the front against a tool holder housing part 362 which is secured axially relative to the tool holder 304 with a securing ring 363. A pressure spring 326 is supported against a retaining ring 361, the other end of the pressure spring 326 contacts a securing ring 364 inserted into the housing part 358. The securing ring 364 and the adjoining disk 365, respectively, simultaneously serve as a stop for the axially displaceable guide tube 306. An angle ring 366 with two bends is provided for this purpose, the angle ring 366 acts on a shoulder 367 of the guide pipe 306 with its inner flange and lies opposite the disk 365 with its outer flange, wherein an O-ring 368 dampens the impact on the disk 365 occurring during idling.

Also in this embodiment, the guide tube 306 is displaced axially forward in the direction of the tool during the transition to idling. When lifting the tool 305, the spring 326 presses the entire tool holder, including the guide tube 306, toward the front until the angle ring 366 or the O-ring 368 strikes the disk 365. In this position, a connection is formed between the idle control opening 314 and the recess 355 of the guide piece 325. The air exchange between the air cushion space 313 and the housing interior or atmosphere is effected via the venting duct 356 and the gaps between the guide piece 325 and the sleeve 357. The rotational movement is further transmitted to the guide pipe 306 via the longitudinal teeth 310 and the sleeve 357, in the event that the switching ring 346 is engaged in the claws 345.

The spring 326 fulfills two functions. Aside from the switching displacement for idling, it takes over the locking of the elements 360 in that it exerts a closing force on the retaining ring 361. Instead of a single spring 326, two separate springs can also be provided in the same position, which springs are supported e.g. at an internal collar attached to the forked part of the tool holder housing part 362.

While the invention has been illustrated and described as embodied in a drill or percussion hammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power hammer drill, comprising a housing; a tool holder located in said housing; an air cushion striking mechanism arranged in said housing for driving a tool and including a striker, a reciprocating piston for displacing said striker, and an axially displaceable guide tube for guiding said piston in reciprocating movement thereof and having at least one control opening for venting an air cushion; and means for holding the striker in a forward position thereof adjacent to said tool holder in an idling condition of said hammer drill, said holding means comprising a guide element supported in said housing for guiding said guide tube during axial displacement of said guide tube, said guide element being fixed in said housing against axial displacement, said control opening having one of closed and open conditions in accordance with an axial position of said guide tube.

2. A power hammer drill as set forth in claim 1, wherein said control opening is an idle control opening located outside a stroke path of said piston.

3. A power hammer drill as set forth in claim 2, further comprising a valve located upstream of said idle control opening for controlling air flow therethrough.

4. A power hammer drill as set forth in claim 1, wherein said guide tube has another control opening, one of said one and another control openings functioning as a venting port during operation of said hammer drill and the other of said one and another control openings functioning as a throttle port in the idling condition of said hammer drill, said guide element closing one of said one and another control opening dependent on whether said hammer drill is in an operational condition or in the idling condition.

5. A power hammer drill as set forth in claim 1, further comprising means for rotating said guide tube, and means for transmitting rotational movement of said guide tube to said tool holder.

6. A power hammer drill as set forth in claim 5, wherein said transmitting means comprises a clutch.

7. A power hammer drill as set forth in claim 5, wherein said guide tube has longitudinal teeth on an outer surface thereof, said rotating means comprising an axially displaceable toothed wheel engaging said longitudinal teeth for rotating said guide tube in every axial position thereof.

8. A power hammer drill as set forth in claim 1, further comprising means for rotating said guide element.

9. A power hammer drill as set forth in claim 8, further comprising a motor for driving said striking mechanism, arranged transverse to an axis of said striking mechanism, and having a pinion; and means for transmitting rotation to said guide element and including a spur gear cooperating with said pinion, and bevel gear toothing means for transmitting rotation from said spur gear to said guide element.

10. A power hammer drill as set forth in claim 8, wherein said guide element is connected to said tool holder for joint rotation therewith.

11. A power hammer drill as set forth in claim 10, wherein said guide element and said tool holder are formed as one piece.

12. A power hammer drill as set forth in claim 10, wherein said guide element comprises a sleeve having tooth means on an outer surface thereof, said power hammer drill further comprising claw means fixed in said housing, and a switching ring having a toothing constantly engaging said tooth means, said switching ring being axially displaceable to a position in which it engages a claw provided on a rotatable part for transmitting rotation to said guide element, and to a position in which it engages said claw means fixed in said housing for securing said guide element against rotation.

13. A power hammer drill as set forth in claim 8, wherein said guide tube is integral with said tool holder, said power hammer drill further comprising a switching coupling located between said guide element and said guide tube for transmitting rotation of said guide tube.

* * * * *